US006722755B2

(12) United States Patent
Shigeno

(10) Patent No.: US 6,722,755 B2
(45) Date of Patent: Apr. 20, 2004

(54) INK-JET RECORDING APPARATUS

(75) Inventor: Kenji Shigeno, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/059,017

(22) Filed: Jan. 30, 2002

(65) Prior Publication Data

US 2002/0101471 A1 Aug. 1, 2002

(30) Foreign Application Priority Data

Jan. 31, 2001 (JP) ..... 2001-024666

(51) Int. Cl.[7] ..... B41J 2/165
(52) U.S. Cl. ..... 347/24; 347/32; 347/30
(58) Field of Search ..... 347/23–36

(56) References Cited

U.S. PATENT DOCUMENTS 5,475,404 A * 12/1995 Takahashi et al. ..... 347/23
5,712,668 A * 1/1998 Osborne et al. ..... 347/32
6,062,672 A * 5/2000 Ishize et al. ..... 347/30
6,252,615 B1 6/2001 Yoshino ..... 347/36
6,447,095 B1 9/2002 Kanda et al. ..... 347/30

FOREIGN PATENT DOCUMENTS

EP 525988 * 6/1992

* cited by examiner

*Primary Examiner*—Stephen D. Meier
*Assistant Examiner*—Ly Tran
(74) *Attorney, Agent, or Firm*—Fitzpatrick, Cella, Harper & Scinto

(57) ABSTRACT

The objective of the present invention is to provide an ink-jet recording apparatus having a stable recovery means capable of absorbing discharged ink by a discharged ink holding means, preventing ink discharge openings from clogging and maintaining eject recovery performance. For that purpose the ink-jet recording apparatus is arranged as follows. A recording means having a plurality of nozzles and nozzle rows for ejecting ink, a reciprocatingly moving carriage on which the recording means is mounted, a recovery means for recovering or maintaining an ink eject status, and a discharged ink holding means for absorbing discharged ink from the recovery means and for keeping discharged ink from flowing out of the apparatus, where pigment ink and dye ink discharge openings are arranged closely so that both discharged inks are mixed so as to dissolve a stuck deposition of the pigment ink or to suppress the stuck deposition.

8 Claims, 17 Drawing Sheets

INK-JET RECORDING APPARATUS

BACKGROUND OF THE INVENTION

1. Field of the Invention

The present invention relates to an ink-jet recording apparatus for recording by ejecting ink from a recording means onto a medium to be recorded.

2. Brief Description of the Related Art

Printing apparatuses employing various kinds of printing methods such as a wire-dot method, a thermal method, a thermal transfer method or an ink-jet method have been proposed as mountable print heads to print on printing media (Hereinafter also simply referred as "recording paper") such as paper, cloth, plastic sheets, OHP sheets and the like.

Among these printing apparatuses, a printing apparatus employing the ink-jet printing method (hereinafter also referred as the ink-jet printing apparatus) for ejecting ink and depositing it directly on the recording paper, is a non-impact printing method with low noise, and is capable of performing printings with high density and high quality.

In general, the ink-jet printing apparatus comprises a means for driving a carrier on which the print head is mounted, a feeding means for feeding the recording paper and a control means for controlling aforementioned means.

A piezo-electric element or the like utilizing an electro-mechanical energy converting body, a method of irradiating laser or the like to generate thermal energy for ejecting ink droplets, an electro-thermal energy converting body element having a thermo-resistance body or the like have been known as energy generating elements to generate energy for ejecting ink from ink eject ports of the print head.

Among the above-mentioned print heads, a print head employing the ink-jet printing method for ejecting ink as ink droplets by utilizing thermal energy is capable of printing with high resolution, since ink eject ports can be densely arranged.

Above all, a print head employing the electro-thermal energy converting body element as the energy generating element can be easily reduced in its size with densely packaged structure at low cost by utilizing IC related technologies and micro-fabricating technologies supported by advanced technologies and reliabilities attained in the recent semi-conductor manufacturing field.

As mentioned above, the ink-jet printing method is the quite excellent printing method with a relatively simple arrangement, but still there are problems to be solved.

When the ink-jet recording apparatus has not been used for a long period or when one particular eject port among a plurality of eject ports rarely ejects ink compared with other eject ports, ink ejecting performance is deteriorated owing to ink thickening due to evaporating water in ink around the eject port or an ink chamber communicating to the eject port.

Sometimes ink ejecting directions are deviated, when ink droplets are attracted by deposits derived from such as ink droplets, water droplets or dusts deposited on the eject port surface of the head where eject ports are arranged.

In order to prevent the above-mentioned problems, the so-called eject recovery device equipped in the conventional ink-jet recording apparatus employs the following measures.

As measures for preventing non-eject statuses, the following operations have been employed: a pre-ejection for removing thickened ink or the like by ejecting ink into an ink accepting body before printing; an ink suction for sucking ink from eject ports and a common liquid chamber for removing deposited objects; the ink suction for removing bubbles generated in ink when exchanging ink tanks and a capping measure to prevent water from evaporating out of eject ports.

An ink-jet recording apparatus capable of color printing equipped with the following arrangements has been developed: a plurality of eject port groups for magenta, cyan and yellow inks and the like, except black ink arranged in the same recording head; ink tanks and ink supply systems independently arranged in the respective eject port groups; and a common cap and other eject recovery means for respective groups.

In this type of the recording apparatus, different kinds of inks for black ink and color ink, namely, pigment ink for black ink and dye ink for color ink, have been employed in view of a coloring property for printing in black and of a color reproducibility for printing in color, so that specific caps and suction means for respective pigment ink and dye ink have been arranged in the recording apparatus.

In this case, eject recovery operations for black ink and color ink are respectively executed, and sucked black ink and color ink are discharged from respective discharge openings arranged at different positions.

In FIGS. 18 to 20, positions of discharge pipes of a recovery device equipped in the conventional recording apparatus are schematically illustrated. FIG. 18 is a bottom view of the recovery device schematically illustrating sucked ink discharge openings 54 and 55 for black and color inks. FIG. 19 is a perspective view of the recovery device showing sucked ink discharge openings 54 and 55 respectively formed at tips of suction tubes 32*a* and 32*b* for black ink and color ink. Ink discharge openings 54 and 55 are arranged to discharge sucked inks in parallel directions and arranged apart from each other such that discharged black and color inks do not mix each other.

In the conventional recovery device, when particularly black pigment ink is ejected, only black ink is sucked for maintaining eject ports in accordance with a printing frequency, but color dye ink is rarely sucked.

Consequently, the ink discharge opening 54 formed at the tip of the black ink suction tube 32*a* is occupied by discharged black ink and is finally clogged by the stuck black ink around discharge opening 54 as shown in FIG. 20. A reference numeral "60" in the figure is stuck black ink. On the other hand discharged color ink 61 discharged from the color discharge opening 55 does not clog the opening 55.

When the above-mentioned stuck status further develops, the recovery device cannot suck sufficient ink from eject ports, which results in insufficient maintenance statuses in eject ports.

Since pigment ink tends to stick easily compared with dye ink due to its properties, stuck pigment ink discharged from the pigment ink discharge opening deposits around the discharge opening and clogs the discharge opening when stuck pigment ink grows as shown in FIG. 20, which aggravates eject recovery performances. Discharged ink starts sticking to a surface of an ink holding means after it is absorbed by the ink holding means so that the absorptivity of the ink holding means is also deteriorated.

SUMMARY OF THE INVENTION

The present invention is carried out in view of the above-mentioned technical problems for providing an ink-jet recording apparatus equipped with an ink eject recovery means capable of stably maintaining the eject recovery performance in normal statuses by discharging dye ink over discharged pigment ink. The recovery means attains the following features: pigment ink is prevented from sticking and depositing; pigment ink is absorbed by the absorbing means more efficiently; and the pigment ink is prevented from clogging around the pigment ink discharge opening.

Objectives of the present invention are attained by providing either one of manufacturing methods of the ink-jet recording head or either one of manufactured recording heads specified in (1) to (8).

(1) An ink-jet recording apparatus comprising: a pigment ink eject portion equipped with pigment ink eject ports for ejecting pigment ink; a dye ink eject portion equipped with dye ink eject ports for ejecting dye ink; a pigment ink recovery means for recovering or maintaining an eject status of pigment ink to be ejected from the pigment ink eject ports; a dye ink recovery means for recovering or maintaining an eject status of dye ink to be ejected from the dye ink eject ports; a discharged ink holding means for holding inks discharged respectively from the pigment ink recovery means and the dye ink recovery means; a discharged pigment ink discharge opening for discharging discharged pigment ink from the pigment ink recovery means to the discharged ink holding means; and a discharged dye ink discharge opening arranged closely to the discharged pigment ink discharge opening, for discharging discharged dye ink from the dye ink recovery means to the discharged ink holding means.

(2) The ink-jet recording apparatus according to (1), where: the pigment ink recovery means comprises a pigment ink cap for capping the pigment ink eject ports and a pigment ink suction means for sucking from the pigment ink eject ports via the pigment ink cap; and the dye ink recovery means comprises a dye ink cap for capping the dye ink eject ports and a dye ink suction means for sucking from the dye ink eject ports via the dye ink cap.

(3) The ink-jet recording apparatus according to (1), where: at least the discharged dye ink discharge opening is arranged apart from the discharged ink holding means.

(4) The ink-jet recording apparatus according to (3), where: the discharged pigment ink discharge opening and the discharged dye ink discharge opening are arranged closely to each other such that mixed discharged ink is absorbed by the discharged ink holding means, after the discharged pigment ink discharged from the discharged pigment ink discharge opening and the discharged dye ink discharged from the discharged dye ink opening are properly mixed.

(5) The ink-jet recording apparatus according to (1), wherein: a recovery operation is executed by the recovery means when the pigment or dye ink eject ports are not in use for a predetermined period.

(6) The ink-jet recording apparatus according to (5), where: the recovery operation by the pigment ink recovery means is executed before the pigment ink starts sticking to the pigment ink eject ports.

(7) The ink-jet recording apparatus according to (1), where: the recording apparatus is equipped with electro-thermal energy converting bodies to generate thermal energy utilized for ejecting ink.

(8) The ink-jet recording apparatus according to (7), where: respective inks are ejected by utilizing film boiling in inks caused by thermal energy generated from the electro-thermal energy converting bodies.

DETAILED DESCRIPTION OF THE PREFERRED EMBODIMENTS

Figure 1:
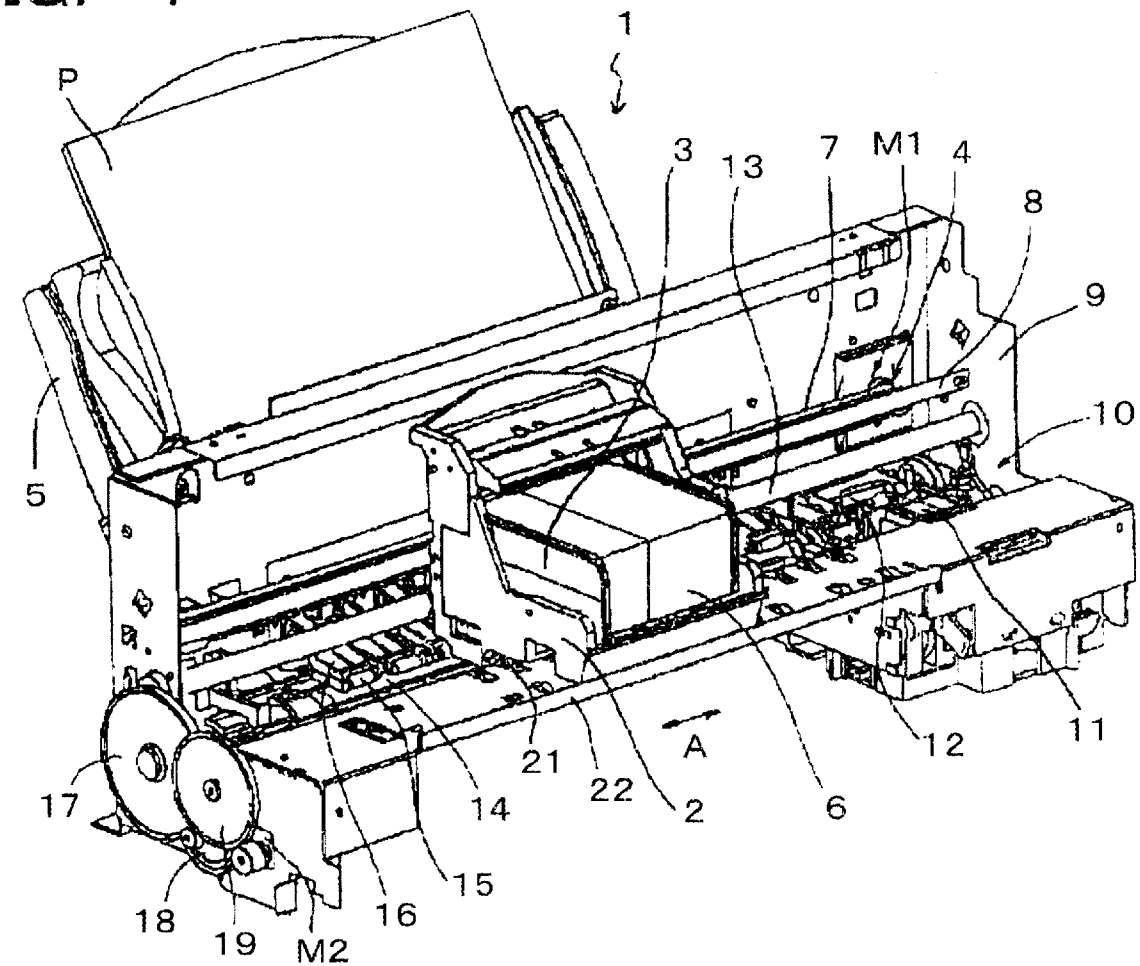
FIG. 1 is a schematic perspective view illustrating the inner structure of the ink-jet recording apparatus according to the present invention.

Hereinafter referring to drawings, embodiments according to the present invention are explained.

Throughout drawings the same reference numerals or characters represent the same members or portions.

Figure 2:
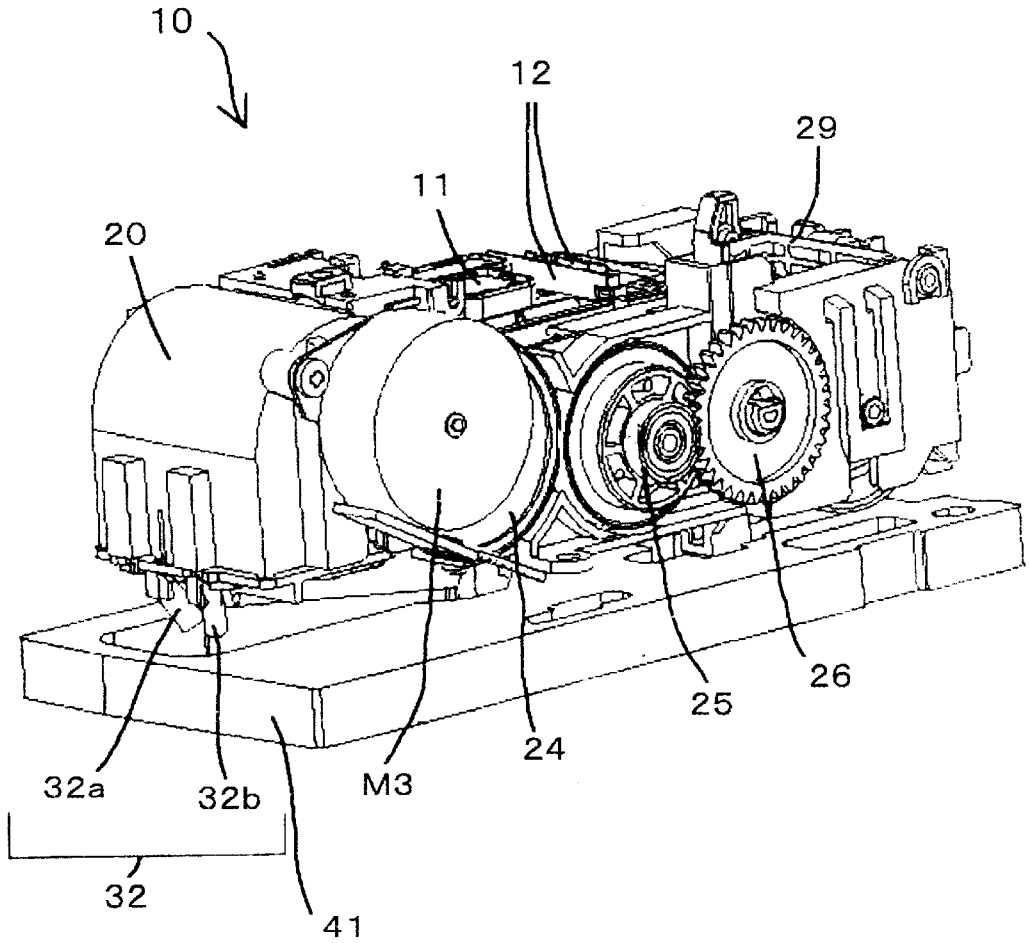
FIG. 2 is a schematic perspective view illustrating the recovery device (recovery means) equipped in the ink-jet recording apparatus.
Figure 3:
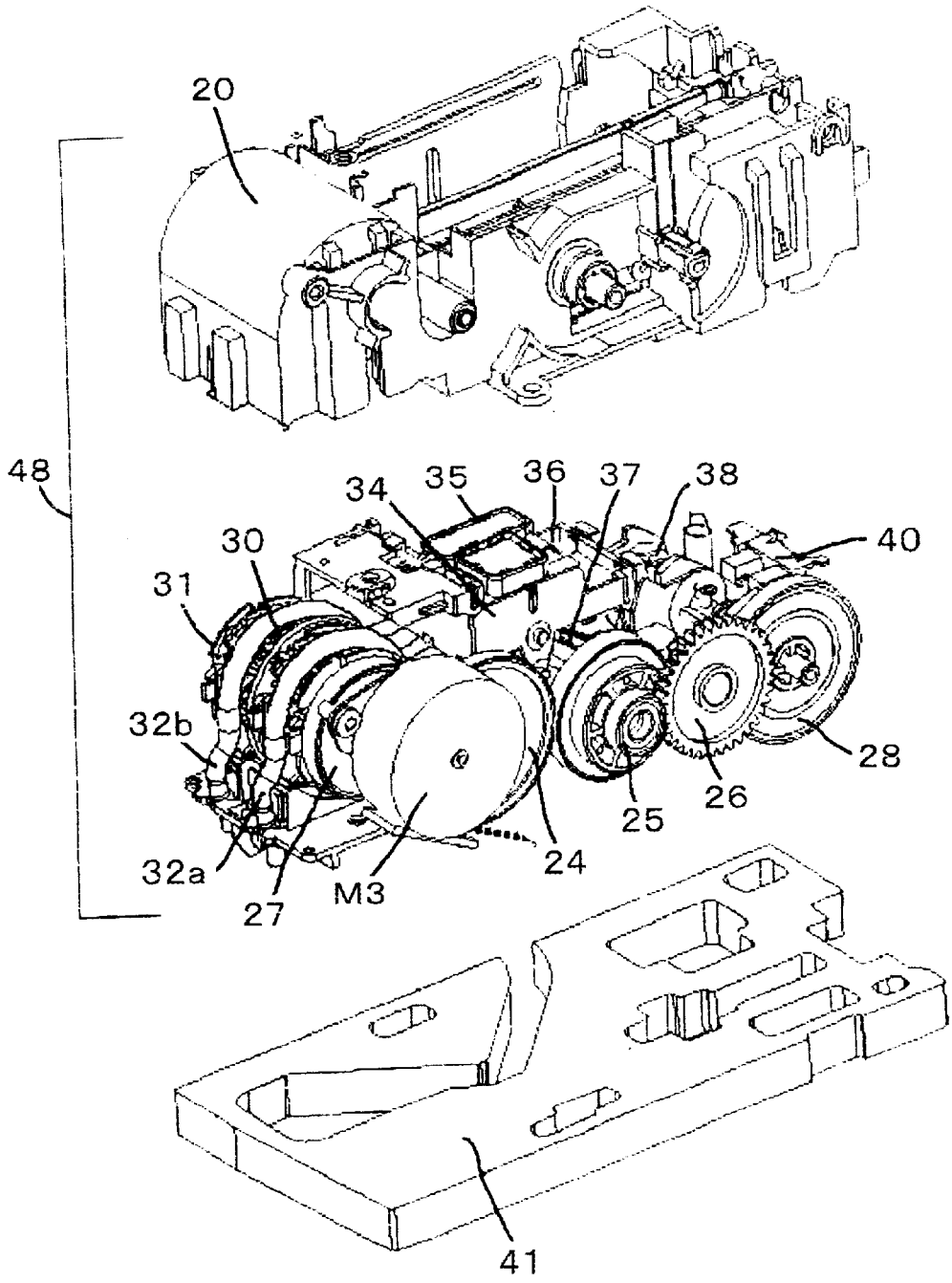
FIG. 3 is a schematic exploded perspective view illustrating the inner structure of the recovery device shown in FIG. 2.

FIG. 1 is the schematic perspective view illustrating the inner arrangement of the ink-jet recording apparatus according to the present invention. FIG. 2 is the schematic upper perspective view illustrating the recovery device including the recovery means equipped in the ink-jet recording apparatus shown in FIG. 1. FIG. 3 is the schematic exploded perspective view illustrating the inner structure of the recovery device mounted on the ink-jet recording apparatus (shown in FIG. 1) according to the present invention.

In FIG. 1 to FIG. 3, a reference numeral "1" is an ink-jet recording apparatus equipped with a carriage motor M1 as a driving source, a carriage 2 on which an ink-jet recording head 3 is mounted, a transmission mechanism 4 which moves the carriage 2 reciprocatingly in directions depicted by an allow A by the carriage motor M1, a paper supply mechanism (a paper feed mechanism) 5 which feeds (sends) a recording paper P, a medium to be recorded, and an ink eject recovery device 10 for maintaining the eject port surface clean so as to recover ink ejection in the recording head 3.

In the ink-jet recording apparatus 1, the recording paper P is sent by the paper supply mechanism 5 and required recording is executed on the recording paper P by the recording head 3.

An ink cartridge 6 is demountably held (mounted) on the carriage 2, a member on which recording head 3 is mounted.

Ink accommodated in the ink cartridge 6 is supplied to the recording head 3.

In this case, contact surfaces of the carriage 2 and recording head 3 are properly contacted so as to maintain a required electrical connection between them.

The recording head 3 is a recording head for the ink-jet recording apparatus where ink is selectively ejected from a plurality of eject ports by applied energy to the recording head 3 in accordance with recording signals.

The recording head 3 is an ink-jet recording means to eject ink by utilizing thermal energy and is equipped with electro-thermal energy converting bodies for generating thermal energy.

The recording head 3 ejects ink by utilizing pressure fluctuations caused by growing/shrinking bubbles generated from film boiling brought by applied thermal energy from electro-thermal energy converting bodies.

The energy converting bodies are arranged at positions corresponding to respective eject ports for ejecting ink from corresponding eject ports by applied voltages to the corresponding bodies in accordance with recording signals.

Figure 17:
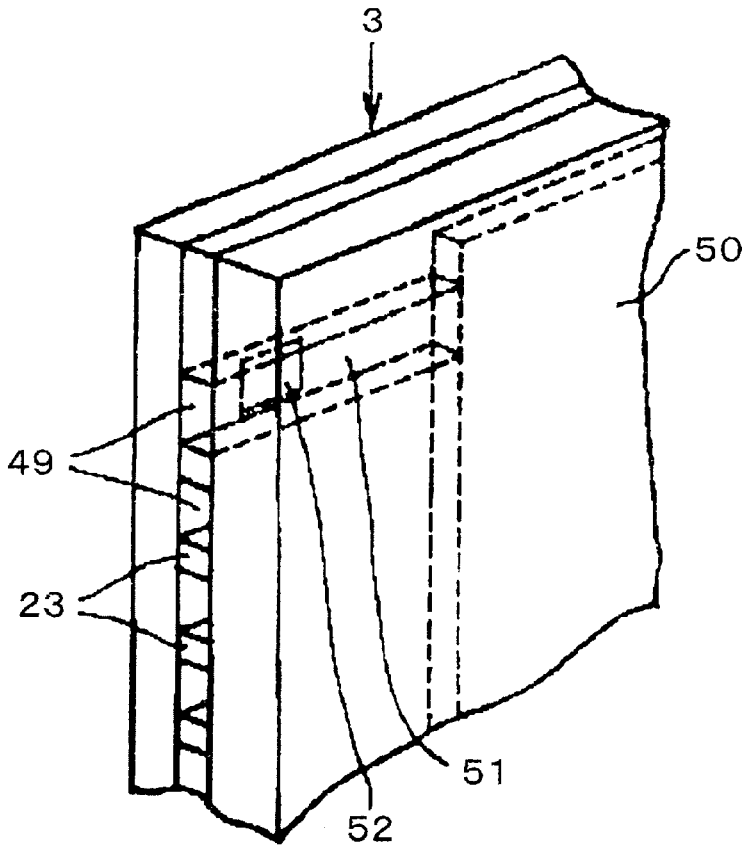
FIG. 17 is a partial perspective view illustrating a structure of the ink eject portion of the recording means shown in FIG. 1.
Figure 18:
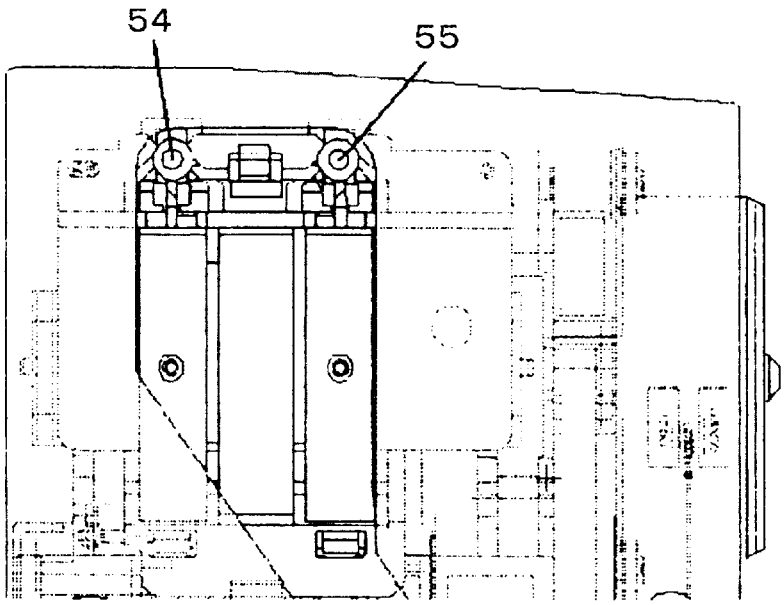
FIG. 18 (PRIOR ART)
FIG. 18 is a schematic bottom view illustrating positions of ink suction tubes in a conventional embodiment.
Figure 19:
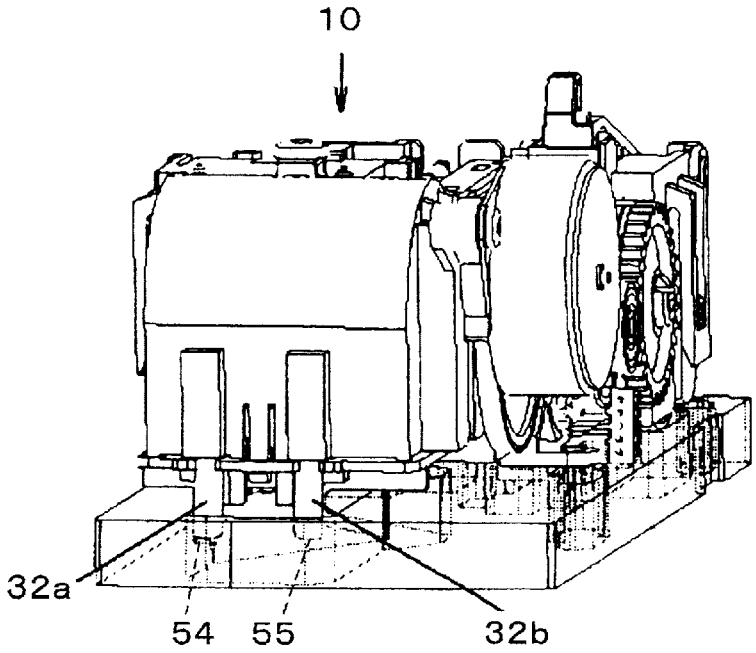
FIG. 19 (PRIOR ART)
FIG. 19 is a schematic perspective view illustrating the recovery means and positions of ink suction tubes in the conventional embodiment.

FIG. 17 is the partial perspective view schematically illustrating the structure of ink eject portion (one eject port row) of the recording means (recording head) 3.

In FIG. 17, a plurality of eject ports 49 are formed with a predetermined pitch on eject port surface 23 facing the medium P to be recorded (recording paper or the like) with a predetermined spacing (for example, ca. 0.3 to 2.0 mm). Electro-thermal energy converting bodies (exothermic resistance or the like) 52 to generate energy for ejecting ink are respectively arranged along walls of respective liquid paths 51, via which respective eject ports 49 are communicated to a common liquid chamber 50.

The recording head 3 is guided and supported in a status where the eject ports 49 are arranged in a row crossing a main scanning direction (in this embodiment the moving direction A of the carriage 2 on which the recording head is mounted, see FIG. 1).

The recording means (recording head) 3 is arranged to eject ink droplets from eject ports 49 by utilizing the generated pressure by the film boiling in liquid paths 51 by driving (applying pulse voltages to) corresponding electro-thermal energy converting bodies 52 in accordance with image signals or ejection signals.

As shown in FIG. 1, the carriage 2 is linked to a portion of a driving belt 7 of the transmission mechanism 4 which transmits the driving force from the carriage motor M1. The carriage is guided/supported by a guide shaft 13 so as to move slidingly in the direction A so that a driving force from the carriage motor M1 is transmitted to the carriage.

Consequently, the carriage 2 moves reciprocatingly along a guide shaft 13 in accordance with forward/backward rotations of the carriage motor M1.

A reference numeral "8" is a scale to indicate an absolute position of the carriage 2 in the direction of the arrow A. In this embodiment the scale 8 is formed out of transparent PET film on which black bars are printed with a predetermined pitch. One end of the scale 8 is fixed to a chassis 9 and the other end of the scale 8 is supported by a flat spring (not shown in the figure).

In the ink-jet recording apparatus 1 shown in the figure, a platen (not shown) is arranged so as to face against the eject port surface, where eject ports (not shown) are formed, of the recording head 3. Along the full width of the recording paper P, the medium to be recorded, fed to the platen, recordings are executed by driving reciprocatingly the carriage 2 on which the recording head 3 is mounted by the driving force from the carriage motor M1, and concurrently ejecting ink in accordance with recording signals to the recording head 3.

A reference numeral "14" is a feed roller driven by a feed motor M2 for feeding the recording paper. A reference numeral "15" is pinch rollers for pressing the recording paper against the feed roller 14 by a spring (not shown). A reference numeral "16" is pinch roller holders for rotatingly supporting the pinch rollers 15.

A reference numeral "17" is a feed roller gear fixed to one end of the feed roller 14, which is driven by a revolving movement of the feed motor M2 transmitted via an intermediate gear 18.

A reference numeral "19" is an eject roller gear fixed to an eject roller (not shown in FIG. 1) for ejecting the recorded paper on which image is formed by the recording head 3. The eject roller is driven by the revolving movement of the feed motor M2, transmitted via the intermediate gear 18 to the eject roller gear 19.

A reference numeral "21" is a spur roller for pressing the recorded paper against the eject roller via a spring (not shown). A reference numeral "22" is a spur roller holder for rotatably supporting the support roller 21.

The ink eject recovery device 10 for recovering the recording head 3 from a poor eject status, is arranged at a desired position (for example a position facing against a home position of the recording head 3), but outside the reciprocating movement area for recording (outside recording area) of the carriage 2 on which the recording head 3 is mounted.

A capping means 11 for capping the eject port surface of the recording head 3 and a wiping means 12 for cleaning the eject port surface of the recording head 3 are equipped in the recovery device 10. Together with the capping movement on the eject port surface by the capping means 11, ink is forcibly ejected by a suction means (not shown, such as a suction pump and the like) equipped in the ink eject recovery device 10. Thus eject recovery operations for removing thickened ink, bubbles and the like in liquid paths of the recording head 3 can be executed.

In addition, not only the recording head can be protected by capping the eject port surface of the recording head 3 during non-print operations, but also ink can be prevented from drying.

The wiping means 12 is arranged in the vicinity of the capping means 11 so as to wipe up stuck ink on the eject port surface of the recording head 3.

The capping means 11 and the wiping means 12 can keep the recording head 3 in a normal status.

Hereinafter an arrangement of the recovery device 10 including the recovery means is explained by referring FIGS. 2, 3 and 4.

The recovery device 10, a means for recovering the recording head from the poor eject status, comprises a suction means 48 (see FIG. 3), the capping means 11 and the wiping means 12.

The suction means 48 in FIG. 13 comprises as follows. Two suction tubes 32 are guided along an inner circular surface of a base cover 20 of the suction means. Two pressurizing rollers 33 are arranged to each suction tube. The pressurizing rollers 33 are pressed against the suction tubes 32 by springs (not shown in drawings) for generating negative pressure in suction tubes 32. Axes of pressurizing rollers 33 are placed in oval openings of pressurizing roller holders 31 so that the pressurizing rollers 33 are in pressurizing positions against suction tubes 32 during suction operations and in idle positions during non-suction operations.

In this embodiment, since the base cover 20 has semi-circular inner surface so as to guide two suction tubes, one of the two pressurizing rollers 33 always presses against the suction tube 32 while the other pressurizing roller 33 is in the idle position, when two pressurizing rollers 33 are diagonally arranged 180 degrees apart on the circle formed by the base plate cover 20. Thus, continuous suction operations are attained when pressurizing rollers 33 are revolved continuously as being kept the suction tubes 32 at the negative pressure.

When the base cover has a nearly full circular guide surface, even one pressurizing roller may attain the same result as mentioned above.

Even when the base cover has the semi-circular guide surface, the continuous suction operations are attained by employing two or more pressurizing rollers.

Figure 6:
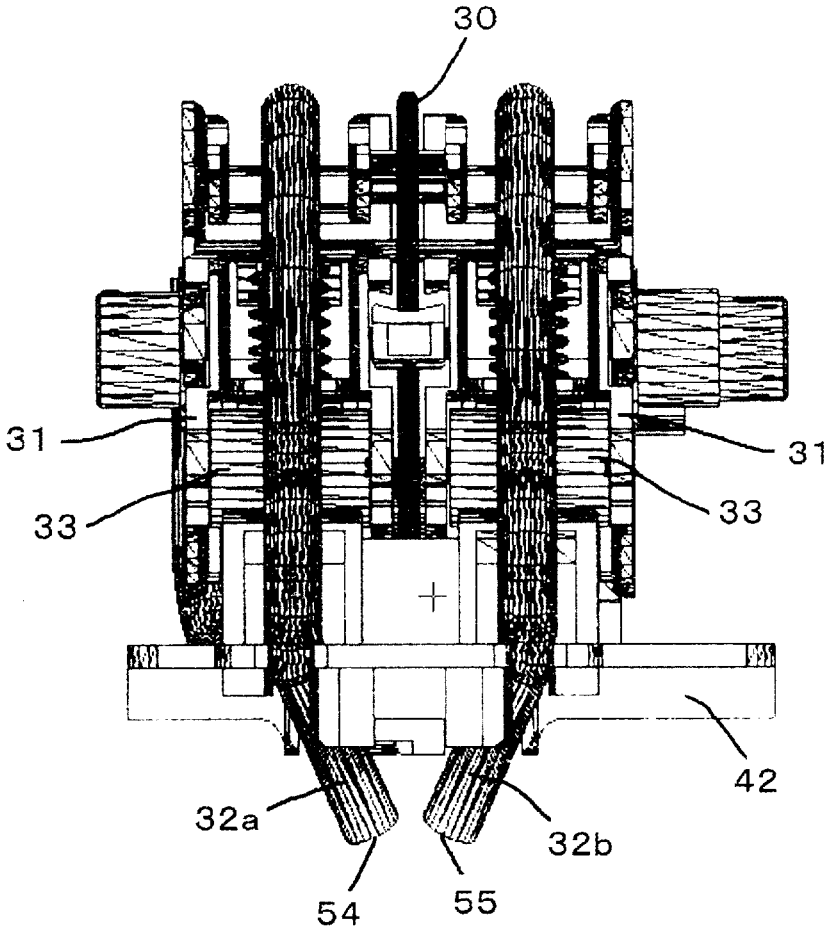
FIG. 6 is a schematic front view illustrating positions of sucked ink discharge openings of ink suction tubes in the recovery device.

As shown in FIG. 6 the pressurizing roller holders 31 are axially fitted to a pressurizing roller holder guide 30 so as to revolve in a radial direction of the circular guide surface of the base cover 20 for attaining pressurizing/idle positioning of pressurizing rollers 33 against suction tubes 32.

The pressurizing roller holder guide 30 has axes on both sides and rotatably fitted to the circular center formed by the inner guide surface of the base cover 20 where suction tubes 32 are arranged so as to transmit a driving power from a PG motor M3 (shown in FIG. 3) for revolving the pressurizing roller holder guide 30.

Suction recovery operations are executed by revolving the pressurizing roller holder guide 30 by the driving force from the PG motor M3 via a PG gear 24 and a pump gear 27 arranged in the suction means 48 as shown in FIG. 3.

The revolving force from the PG motor M3 is directly linked to the suction means 48 so as to revolve in a circular direction for the suction operation (hereinafter referred as "forward revolution") and to revolve in a reversed direction for moving the pressurizing rollers 33 from a pressurizing status to a pressure free status against suction tubes 32 (hereinafter referred as "backward revolution").

In this embodiment, the suction means 48 is driven by one driving source arranged in the recovery device, but other different driving sources are also applicable to the suction means 48.

Figure 4:
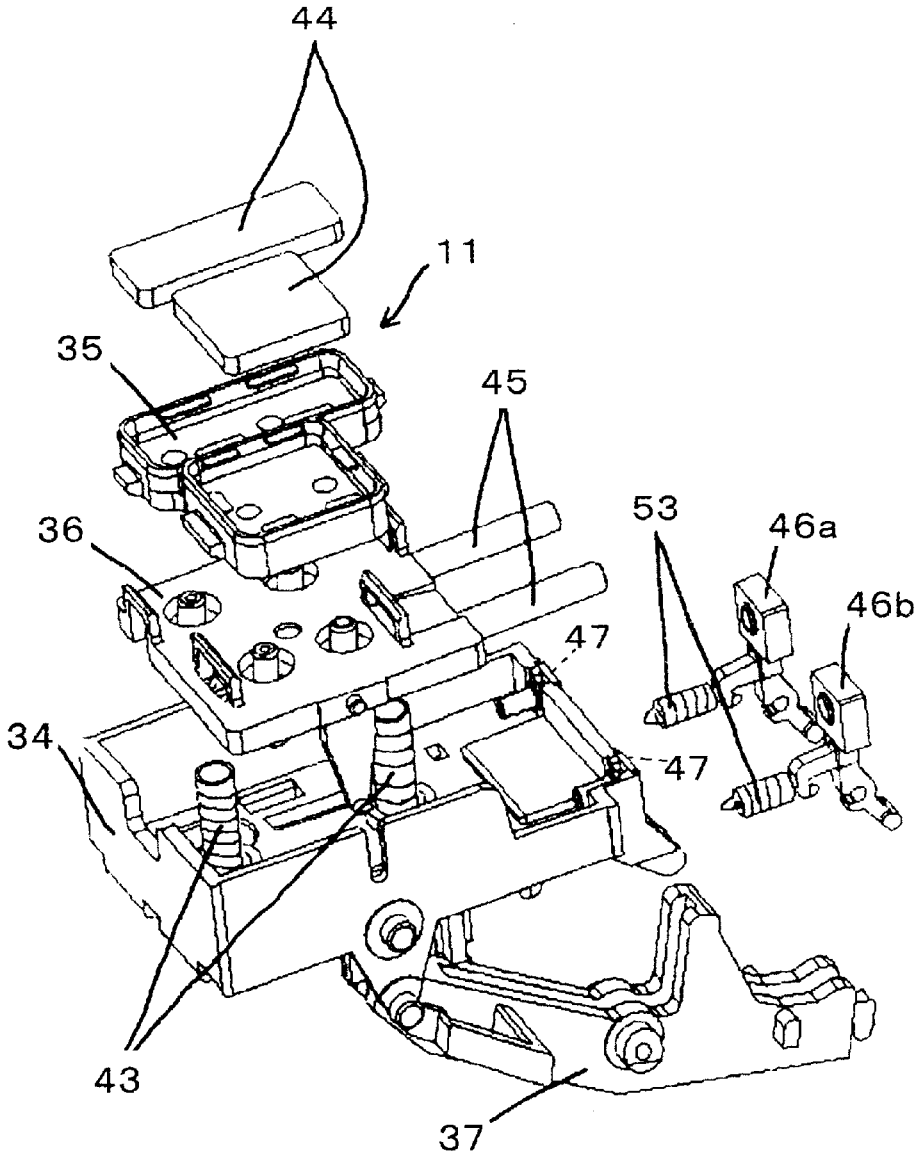
FIG. 4 is a schematic exploded perspective view illustrating the inner structure of the capping means of the recovery device.

As shown in FIG. 4, the capping means 11 comprises as follows: a cap 35, which is separated into two spaces for black and color ink eject ports by a rib, directly contacted with the eject port surface of the recording head 3; cap absorbers 44 for effectively absorbing discharged ink from eject port surface of the recording head 3; a cap holder 36 for supporting the cap 35, capable of pressing the cap 35 against eject port surface of the recording head 3 via compression springs 43; a cap base 34 for supporting compression springs 43 against the cap holder 36 and for supporting the cap holder 36 so as to slide flexibly upward/downward; a cap lever 37 functioning as an arm to attach/detach the cap 35 to/from the eject port surface of the recording head 3; communicating tubes 45 to the atmosphere for connecting cap 35 with communicating holes 47 to the atmosphere formed in the cap base 34; and communicating valves 46*a* and 46*b* for opening/closing communicating holes 47 by springs 53 so as to bring the inside of the cap 35 in open/close status.

In the capping means 11, the suction tubes 32 of the suction means 48 are linked to joints formed on the cap holder 36 so as to suck ink from the recording head 3 by applying the negative pressure caused by the suction movements of the suction means 48 to the cap 35 while the capping means is pressed against the ink eject port surface of the recording head 3.

Upward/downward movements of the capping means 11 for pressing against the recording head 3 and open/close movements of valves 46*a* and 46*b* are driven by the driving force from the PG motor M3, which is successively transmitted via a PG gear 25 and a PG gear 26 to a cam 38 (see FIG. 3). A one-way clutch gear 28 transmits the driving force to the cam 38 when the PG motor M3 revolves in one direction and the one-way clutch gear 28 disconnects the driving force to the cam 38 when the PG motor M3 revolves in the reverse direction.

The cam 38 not only controls movements of the capping means 11, but also drives the wiping means 12 and controls upward/downward movements of a CR lock lever 29 (see FIG. 2) for positioning the recording head 3 and the capping means 11 of the recovery device during recovery operations of the recording head 3.

The above-described movements of respective means are controlled by revolved positions of the cam 38 determined by flags arranged on the cam 38 and a cam position detecting sensor 40.

The present invention relates to the ink-jet recording apparatus equipped with the recording means having a plurality of eject port rows for ejecting ink, the carriage on which the recording means is mounted moving reciprocatingly and the recovery means for recovering or maintaining the normal ink eject status in eject ports. In addition, the present invention includes features explained hereinafter.

Features of arrangements of ink suction tubes and discharged ink holding means in the suction recovery means equipped in the recovery device of the ink-jet recording apparatus are explained by referring to FIG. 5 to FIG. 13.

Figure 16:
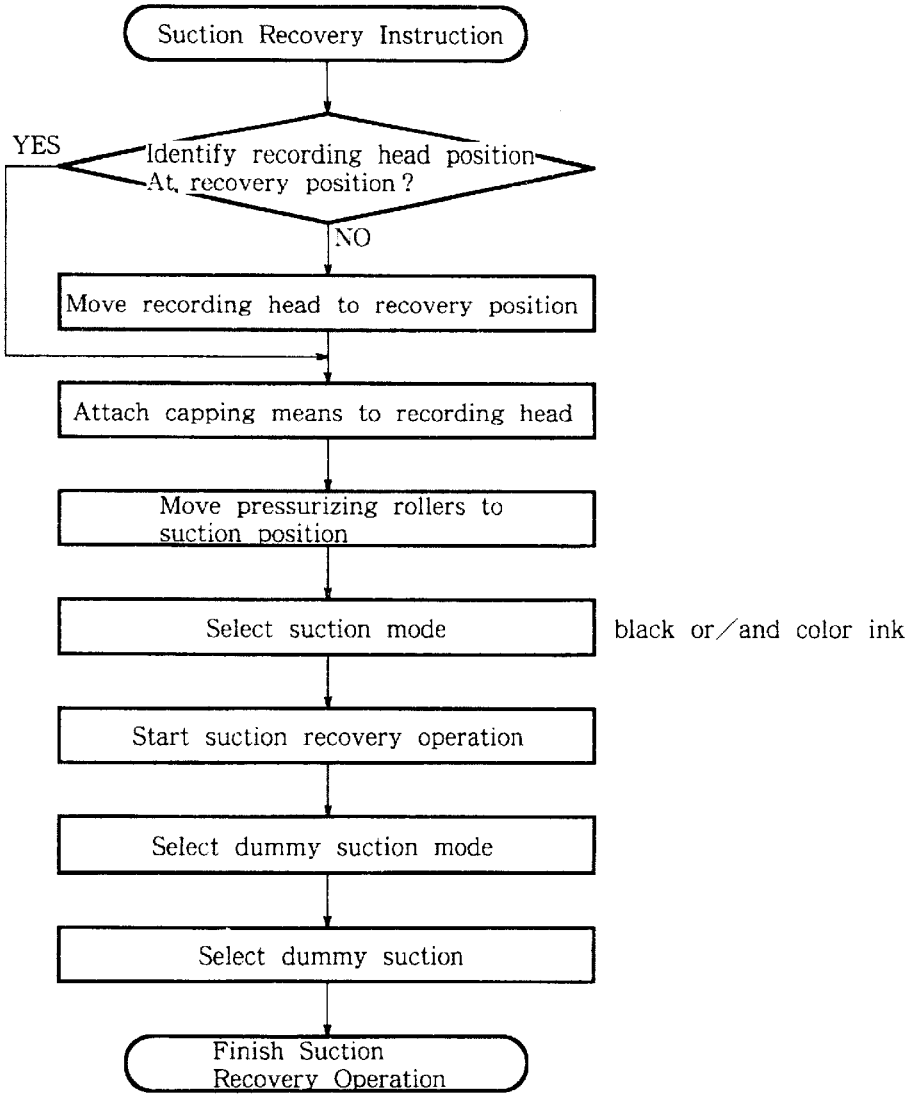
FIG. 16 is a flowchart showing a usual eject recovery sequence executed by the recovery device according to the present invention.

In the embodiment of the present invention, the suction operations by the recovery device against the recording head 3 are executed according to the sequence shown in FIG. 16.

The flow shown in FIG. 16 is a usual suction recovery sequence in the present invention.

Suction instructions shown in FIG. 16 are issued according to accumulated amount of ejected ink from eject ports arranged in the recording head 3 or according to instructions for executing intentional suction operations.

The suction recovery operations in the present embodiment are explained according to the flow in FIG. 16.

When a suction instruction for recovery operation is issued, a position of the cam 38 which is a member of the eject recovery device, is detected by the cam position detecting sensor 40 (see FIG. 3) and positions of the capping means 11 and the wiping means 12 are identified.

When the recording head 3 is not at the suction recovery position, the recording head 3 is moved to the suction recovery position by the transmission mechanism 4 shown in FIG. 1, after confirming by the cam position detecting sensor 40 that the recording head 3, the capping means 11 and wiping means 12, members of the recovery device, are not in an interfering status each other.

The capping means 11 is attached to the eject port surface of the recording head 3 by revolving the cam 38 driven by the PG motor M3 so as to execute the suction recovery operation.

Figure 13:
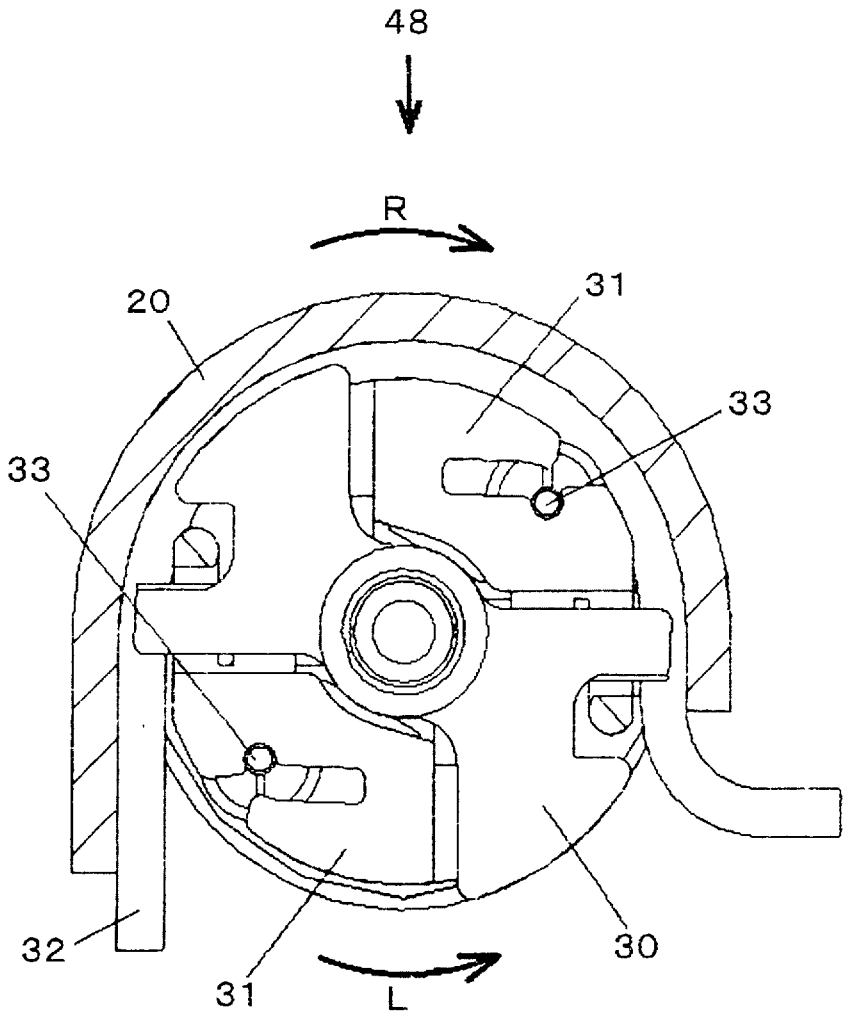
FIG. 13 is a cross-sectional side view illustrating a detailed structure of the suction means shown in FIG. 2 and FIG. 3 arranged in one of the embodiments.

In this step, since the revolving direction of the PG motor M3 is in the R direction shown in FIG. 13, the pressurizing rollers 33 of the suction means 48 are positioned away from suction tubes 32 and the inside of the cap 35 communicates to the atmosphere so that ink remaining in suction tubes 32 does not flow into the inside of the cap 35, and physical damages against eject ports of the recording head 3 caused by the positive pressure are prevented.

After attaching the cap 35 to the eject port surface of the recording head 3, the PG motor M3 is revolved in the L direction shown in FIG. 13 so as to press the pressurizing rollers 33 arranged in the suction means 48 against the suction tubes 32 as a preparation step for the suction recovery operation (a movement of the pressurizing rollers to a suction position before a suction in FIG. 16).

Then a suction mode is selected among suction recovery operations of the recovery device according to the present embodiment, where suction recovery operations are set respectively for black ink and color ink.

The suction mode is selected by opening/closing communicating valves 46*a* and 46*b* of the capping means while the cap 35 is attached to the recording head 3, which brings two spaces for black and color inks inside the cap 35 in open or close status to the atmosphere. In other words, either one/both of the spaces inside the cap 35 where negative pressures are generated by a suction revolving movement of the recovery means 48, are opened/closed to the atmosphere according to ink type(s) to be discharged.

Figure 9:
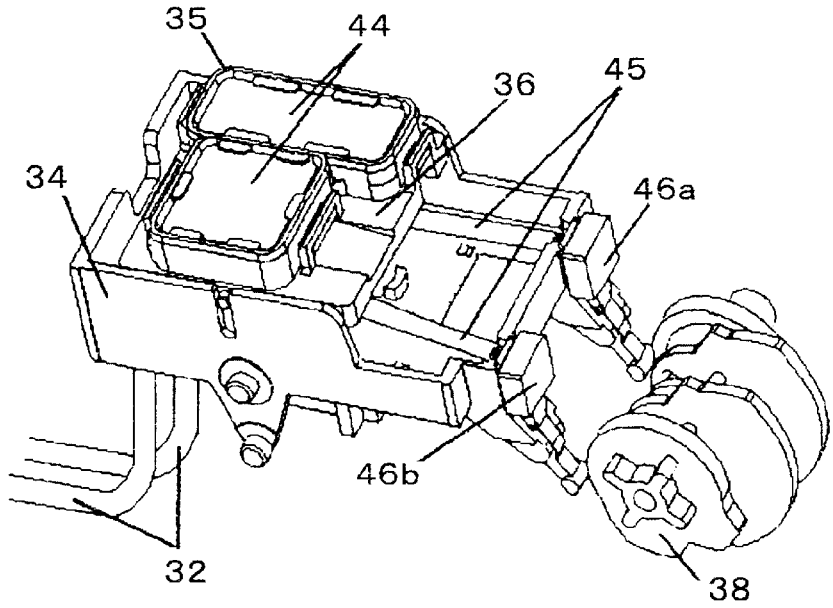
FIG. 9 is a schematic perspective view illustrating a status where both black and color ink communicating valves to the atmosphere arranged in the capping means are closed (cap closed status).
Figure 10:
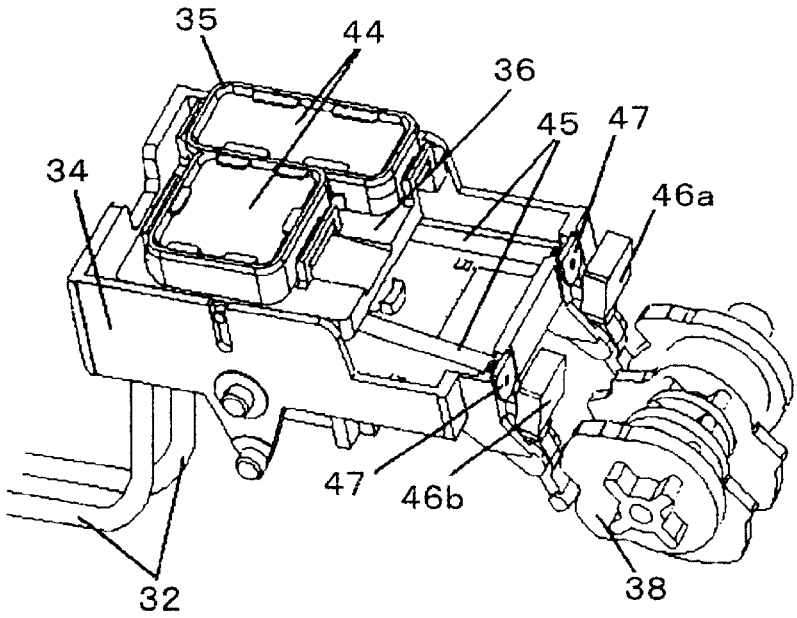
FIG. 10 is a schematic perspective view illustrating a status where both black and color ink communicating valves to the atmosphere arranged in the capping means shown in FIG. 9 are open (dummy suction status).
Figure 11:
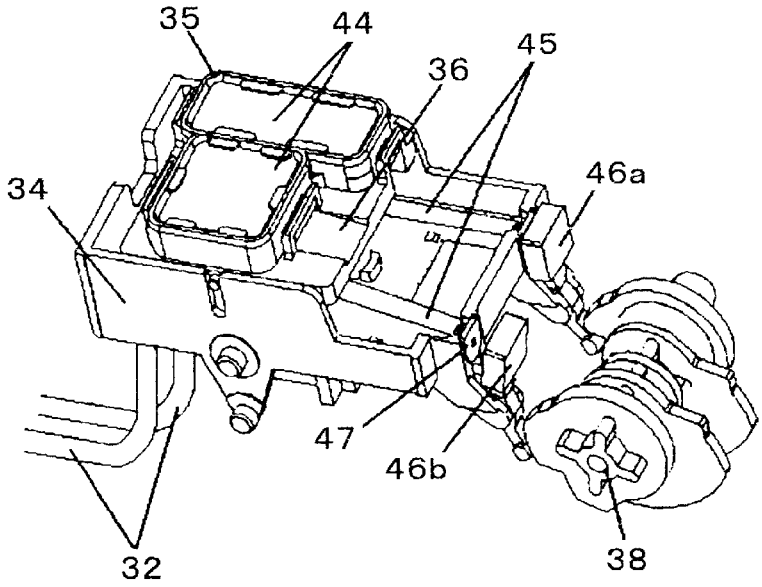
FIG. 11 is a schematic perspective view illustrating a status where the color ink communicating valve to the atmosphere arranged in the capping means shown in FIG. 9 is open and the black ink communicating valve is closed (black ink is in a suction status).
Figure 12:
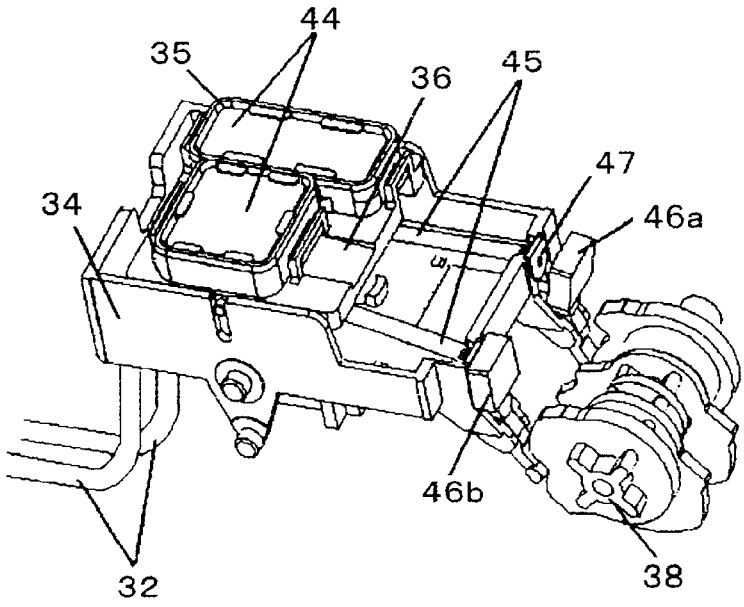
FIG. 12 is a schematic perspective view illustrating a status where the black ink communicating valve to the atmosphere arranged in the capping means shown in FIG. 9 is open and the color ink communicating valve is closed (color ink is in a suction status).

FIG. 9 shows valve positions during the capping status to protect the eject port surface of the recording head 3. FIG. 10 shows valve positions during preparing suction recovery operations (the above-mentioned movement of the pressurizing rollers before suction) to keep inside of the cap 35 in a communicating status to the atmosphere and in a dummy suction status for discharging ink inside the cap 35. FIG. 11 shows valve positions where the recovery device is in a suction status for black ink. FIG. 12 shows valve positions where the recovery device is in a suction status for color ink.

After selecting the suction mode, the driving force from the PG motor M3 is transmitted to the suction means 48 so as to suck predetermined volumes of black and/or color ink according to suction instructions for respective inks.

Then, as shown in FIG. 10 communicating valves 46*a* and 46*b* are opened by revolving the cam 38 so as to discharge sucked ink inside the cap 35 out of the cap 35.

After opening communicating valves 46*a* and 46*b* to the atmosphere, a dummy suction operation for discharging sucked ink inside the cap 35 out of the recovery unit is executed by transmitted driving force from the PG motor M3 to the suction means 48. Ink inside cap 35 is discharged via suction tubes 32 and absorbed by a discharged ink absorber 41 arranged in the discharged ink holding means.

The above-mentioned usual suction operations consist of three basic modes i.e. a mode for sucking only black ink, a mode for sucking only color ink and a mode for continuous sucking black and color inks. Various kinds of suction recovery operations can be attained by combining these basic modes.

In order to carry out the above-mentioned suction operations stably, the present invention takes the following measures.

Figure 5:
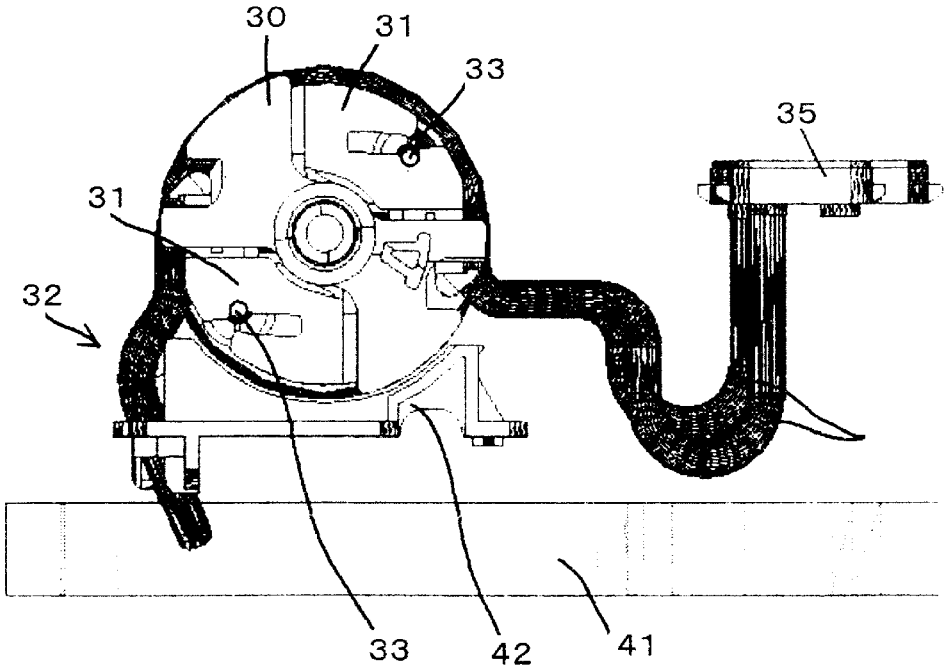
FIG. 5 is a schematic cross-sectional side view illustrating positions of sucked ink discharge openings of ink suction tubes in the recovery device.
Figure 7:
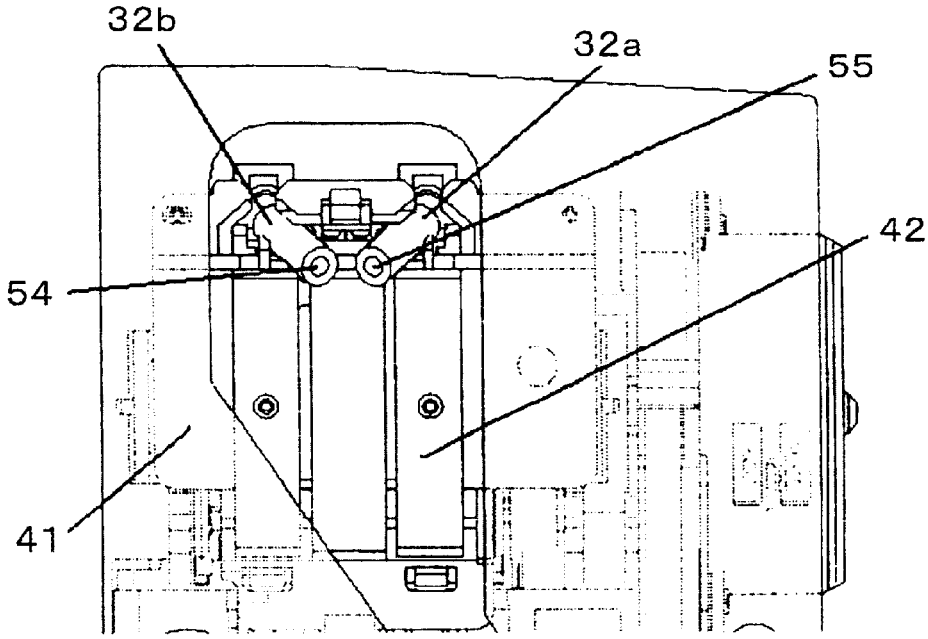
FIG. 7 is a schematic bottom view illustrating a positional relation between sucked ink discharge openings of ink suction tubes and the discharged ink absorbing means.

The recovery device by the present embodiment, shown in FIG. 5, FIG. 6 and FIG. 7, can prevent the deposition caused by stuck black ink according to the following arrangement. A sucked ink discharge opening 54 of the sucked pigment black ink suction tube 32*a* and a sucked ink discharge opening 55 of the sucked dye color ink suction tube 32*b* are positioned close to each other with the aid of a suction tube guide 42 so that discharged pigment black ink and dye color ink mix each other in the vicinity of sucked ink discharge openings of the sucked ink suction tubes when suction operations are executed according to respective suction modes.

Figure 8:
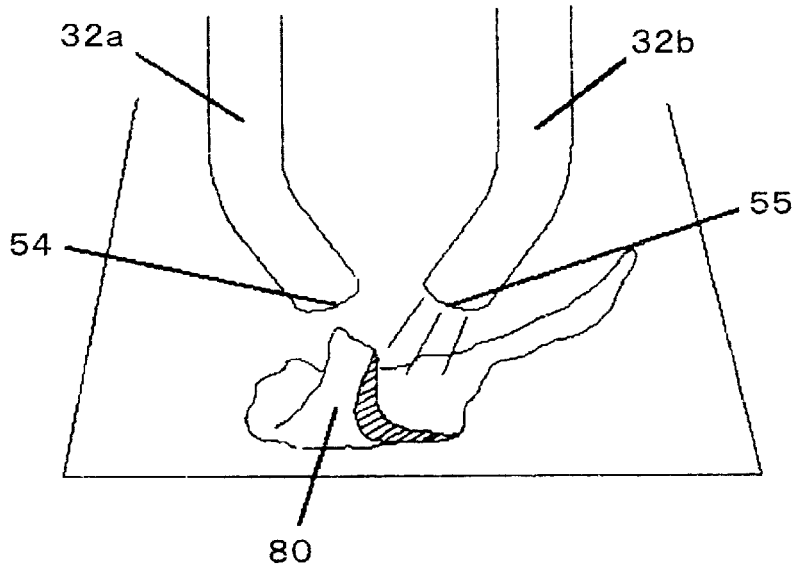
FIG. 8 is a schematic upper perspective view illustrating discharged sucked ink from ink suction tubes and a dissolved status of deposited ink.

As shown in FIG. 8, the above-described arrangement can suppress the ink deposition caused by stuck ink such that discharged color ink (dye ink) can easily mix with stuck black ink 80 (pigment ink) depositing in the vicinity of the sucked ink discharge opening 54 of the sucked black ink suction tube 32*a*.

When mixed printing operations between black and color inks are executed, namely, when suction recovery operations for black ink and for color ink are executed concurrently or alternately, the deposition of the discharged black ink can be suppressed. However, when printing operations in black ink are mainly executed, in other words, when suction operations only for black ink are executed, consequently the same status as in the conventional recovery device where stuck black ink 80 deposits in the vicinity of the sucked ink discharge opening 54 of the sucked black ink suction tube 32*a*, seems to occur.

Figure 15:
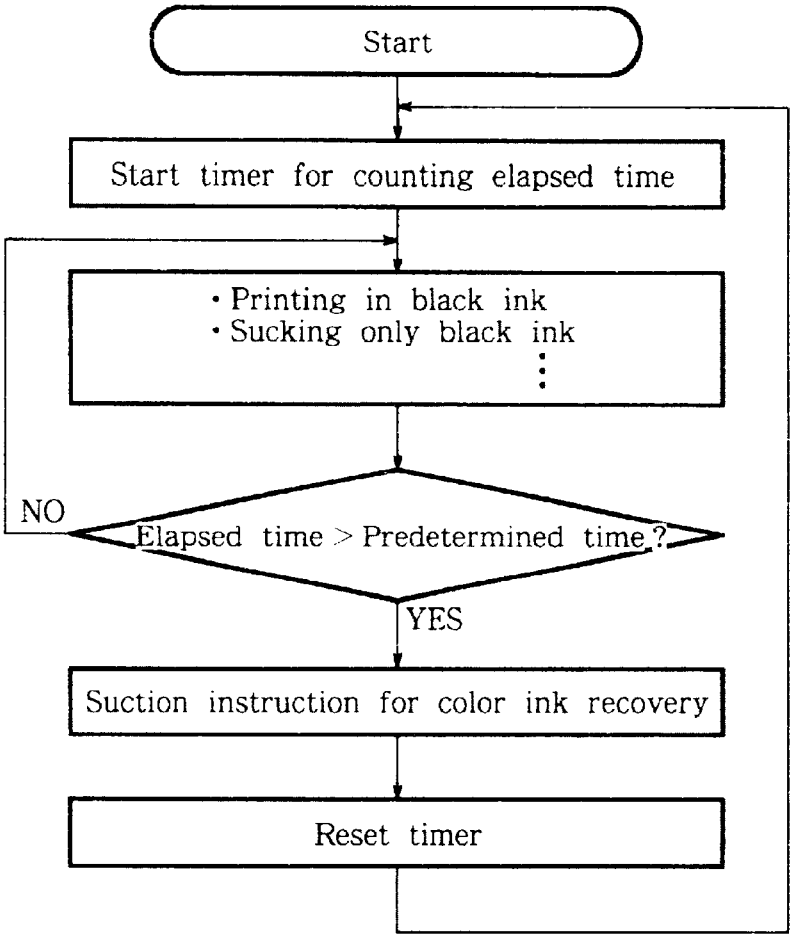
FIG. 15 is a flowchart showing eject recovery timing examples according to the present invention.

As a measure against the above-mentioned problem, the suction sequence is modified as depicted in FIG. 15. The modified suction sequence can suppress discharged black ink from sticking such that when eject ports arranged in the recording head 3 are not used for a predetermined period, the suction recovery operations against color ink are executed regularly so that discharge color ink can dissolve stuck black ink before stuck black ink deposits completely.

The above-described sequence can suppress stuck black ink from deposition, since color ink (dye ink) can mix with black ink (pigment ink) before stuck black ink starts depositing.

Figure 20:
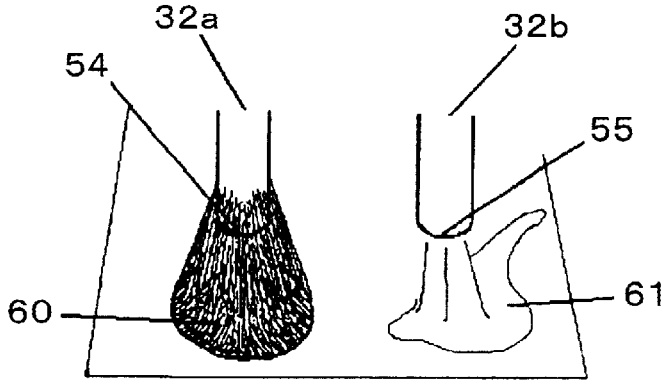
FIG. 20 (PRIOR ART)
FIG. 20 is a schematic upper perspective view illustrating sucked ink discharged from ink suction tubes and a depositing status of discharged ink in the conventional embodiment.

In addition to the above-described arrangements, the discharged ink absorber 41 and suction tubes 32*a*, 32*b* equipped in the recovery device in the present invention are arranged as depicted in FIG. 7 such that discharged black ink and color inks are mixed more efficiently so as to facilitate dissolving stuck black ink, discharge openings of suction tubes in the conventional recovery device are arranged relatively closely to the discharged ink absorber 41 as shown in FIG. 20 such that discharged ink is easily absorbed.

In the above-mentioned arrangement the sucked ink discharge openings of the sucked ink suction tubes are placed apart from the discharged ink absorber to a certain extent so that discharged black and color inks are not immediately absorbed by the discharged ink absorber but absorbed after sufficiently mixed each other, and that the discharged black ink is prevented from being absorbed solely by the discharged ink absorber and from clogging pores of the discharged ink absorber.

In this way, stuck discharged black ink is dissolved by discharged color ink and dissolved solution is absorbed by the discharged ink absorber so that the absorbed solution can suppress clogging pores of the discharged ink absorber, consequently discharged ink is absorbed by the discharged ink absorber more efficiently.

Figure 14:
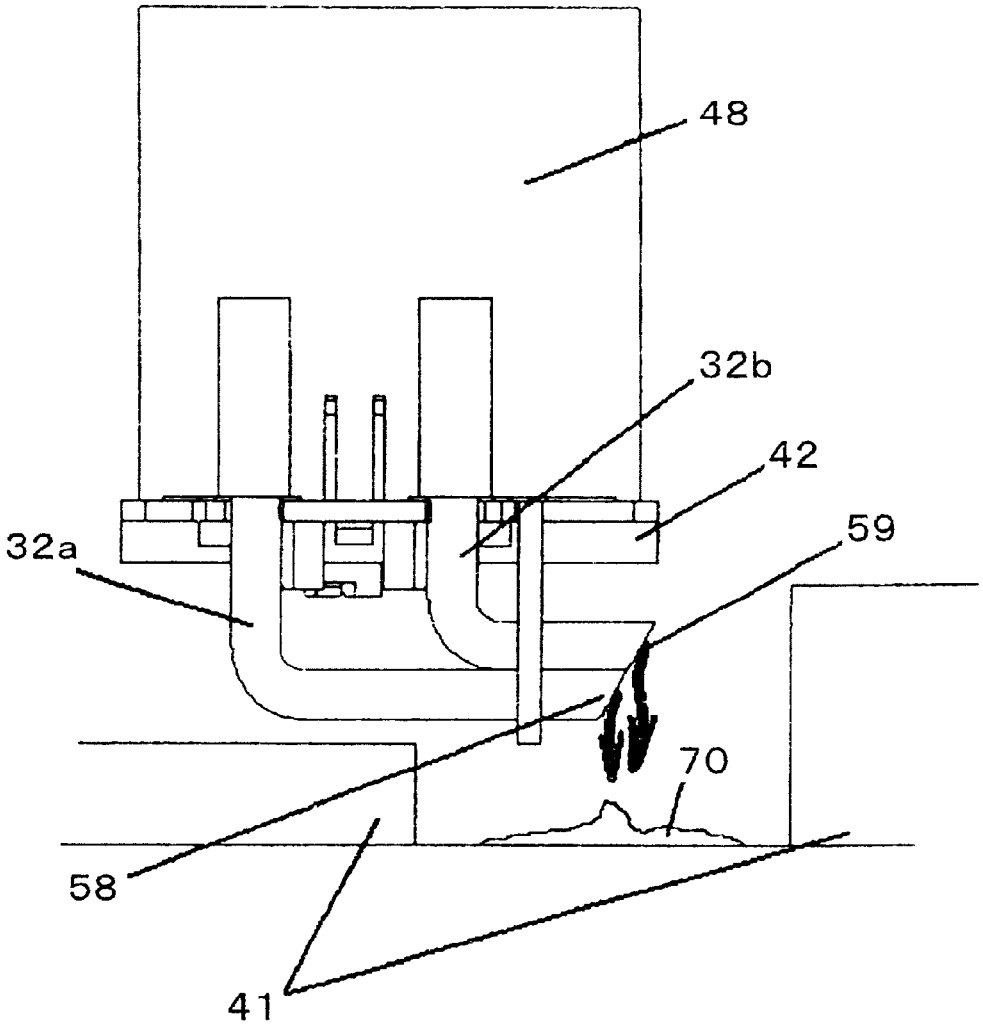
FIG. 14 is a schematic front view illustrating positions of sucked ink discharge pipes according to other embodiment.

FIG. 14 is the schematic figure illustrating other embodiment.

In this embodiment, since a sucked color ink discharge pipe 57 is placed above a sucked black ink discharge pipe 56, discharged color ink can drip on a discharged black ink pool without fail so that discharged black ink is mixed efficiently with discharged color ink and the deposition of discharged black ink can be suppressed.

A discharged black ink deposition 70 in the vicinity of the sucked black ink discharge opening can be suppressed by cutting discharge pipes diagonally to form sucked ink discharge openings 58, 59 so that discharged color ink from the sucked color ink discharge opening 59 flows to the discharged black ink discharge opening 58.

By employing arrangements mentioned above, the present invention can provide an ink-jet recording apparatus with a recovery means having a discharged ink absorbing means capable of absorbing discharged ink efficiently, preventing sucked ink discharge openings from clogging and maintaining eject recovery performance in a stable condition.

In the above-mentioned embodiments, the serial type ink-jet recording apparatus where the recording means moves relatively against the recording medium is explained as the example where the eject recovery means is employed. But the present invention is also applicable to a line type ink-jet recording apparatus utilizing a full or a partial line type recording means where recording is executed by subscanning means, which attains the same effect.

The present invention can be applicable to a recording apparatus having one recording means, a color recording apparatus having a plurality of recording means for different colors or a gradient recording apparatus having a plurality of recording means for different contrasts of the same color and can be also applicable to any combination of preceding recording apparatuses, which can attain the same effects as the embodiments described above.

Further the present invention can be applicable to any arrangement between the recording head and the ink tank, such as an arrangement using an exchangeable cartridge where the recording head and the ink tank are formed in one piece, an arrangement where the recording head and the ink tank are formed in different pieces which are linked by supply tubes or the like. The same effects as in the embodiments described above can be attained in the above-mentioned arrangements.

The present invention can be applicable to a recording head having electro-mechanical energy converting bodies such as piezo-electric elements and the like, but the present invention can be most effectively applied to the ink-jet recording apparatus having the recording means where ink is ejected by utilizing thermal energy, among various recording head types.

As mentioned above, the present invention comprises the following fundamental arrangements. In the ink-jet recording apparatus equipped with the recording means having a plurality of nozzles and nozzle rows ejecting ink from eject ports, the reciprocatingly moving carriage on which the recording means is mounted, the recovery means for recovering or maintaining the stable eject status of ink ejected from the eject ports and the discharged ink holding means for absorbing discharged ink from the recovery means and for keeping discharged ink from flowing out of the apparatus, sucked pigment ink discharge opening and sucked dye ink discharge opening are arranged closely to each other so that both discharged ink mix sufficiently, consequently stuck pigment ink deposition is dissolved or suppressed. Further the recovery means is equipped with the capping means for attaching/detaching the cap to/from the eject port surface of the recording means, the opening/closing means for the communicating valves to the atmosphere for communicating/closing the inner spaces of the cap to/from the atmosphere while the cap is capping the eject port surface of the recording means and the suction means communicated to the cap for executing ink suction recovery. The cap has a plurality of the inner spaces corresponding to a plurality of the nozzle rows. The suction means has a plurality of suction tubes communicating to respective inner space of the cap for sucking and discharging ink. In the fundamental arrangement, sucked ink discharge opening of suction tubes are closely positioned each other so that inks discharged from respective sucked ink discharge openings are mixed. A plurality kinds of inks, either dye ink or pigment ink, ejected from eject ports are used in the recording means. The recovery means is arranged so as to cap the plurality kinds of inks respectively and the suction means can respectively execute suction recovery operations against the plurality of inks. In the suction means at least one sucked ink discharge opening of the suction tube discharging dye ink among the plurality of suction tubes is arranged properly apart from the discharged ink holding means so that discharged dye ink is not immediately absorbed by the discharged ink holding means, but absorbed by the discharged ink holding means after dye ink is mixed sufficiently with pigment ink. Consequently, discharged pigment ink is suppressed from sticking and depositing, is efficiently absorbed by the discharged ink holding means and is prevented from clogging the sucked ink discharge opening when sucked pigment and dye inks are discharged concurrently. Thus the ink-jet recording apparatus having the stable recovery means capable of maintaining the eject recovery performance in a good condition can be provided.

What is claimed is:

1. An ink-jet recording apparatus for recording by ejecting pigment ink and dye ink from a recording head, comprising:

a pigment ink recovery unit for recovering a pigment ink eject portion which ejects pigment ink;

a dye ink recovery unit for recovering a dye ink eject portion which ejects dye ink;

a discharged ink absorber for holding ink discharged respectively from said pigment ink recovery unit and said dye ink recovery unit;

a pigment ink discharge pipe for discharging pigment ink from said pigment ink recovery unit to said discharged ink absorber;

a dye ink discharge pipe for discharging dye ink from said dye ink recovery unit to said discharged ink absorber; and a support member for supporting said pigment ink discharge pipe and said dye ink discharge pipe, wherein said support member supports said dye ink discharge pipe so as to be disposed above said pigment ink discharge pipe.

2. The ink-jet recording apparatus according to claim 1, wherein:

said pigment ink recovery unit comprises a pigment ink cap for capping said pigment ink eject portion and a pigment ink suction means for sucking from said pigment ink eject portion via said pigment ink cap; and said dye ink recovery unit comprises a dye ink cap for capping said dye ink eject portion and a dye ink suction means for sucking from said dye ink eject portion via said dye ink cap.

3. The ink-jet recording apparatus according to claim 1, wherein:

at least said dye ink discharge pipe is arranged apart from said discharged ink absorber.

4. The ink-jet recording apparatus according to claim 3, wherein:

said pigment ink discharge pipe and said dye ink discharge pipe are arranged closely to each other such that mixed discharged ink is absorbed by said discharged ink absorber, after the discharged pigment ink discharged from said pigment ink discharge pipe and the discharged dye ink discharged from said dye ink discharge pipe are properly mixed.

5. The ink-jet recording apparatus according to claim 1, wherein:

a recovery operation is executed by said pigment ink recovery unit or said dye ink recovery unit when said pigment ink eject portion or said dye ink eject portion, respectively, are not in use for a predetermined period.

6. The ink-jet recording apparatus according to claim 5, wherein:

the recovery operation by said pigment ink recovery unit is executed before the pigment ink starts sticking to said pigment ink eject portion.

7. The ink-jet recording apparatus according to claim 1, wherein:

said recording apparatus is equipped with electrothermal energy converting bodies to generate thermal energy utilized for ejecting ink.

8. The ink-jet recording apparatus according to claim 7, wherein:

respective inks are ejected by utilizing film boiling in inks caused by thermal energy generated from said electrothermal energy converting bodies.

* * * * *